US007495174B2

(12) United States Patent
Hase et al.

(10) Patent No.: US 7,495,174 B2
(45) Date of Patent: Feb. 24, 2009

(54) COATED ELECTRIC WIRE

(75) Inventors: Tatsuya Hase, Yokkaichi (JP); Yukihiro Sakamoto, Yokkaichi (JP)

(73) Assignees: Autonetworks Technologies, Limited, Mie (JP); Sumitomo Wiring Systems, Limited, Mie (JP); Sumitomo Electric Industries, Limited, Osaka (JP)

( * ) Notice: Subject to any disclaimer, the term of this patent is extended or adjusted under 35 U.S.C. 154(b) by 137 days.

(21) Appl. No.: 11/597,692

(22) PCT Filed: Jun. 1, 2005

(86) PCT No.: PCT/JP2005/010050

§ 371 (c)(1),
(2), (4) Date: Nov. 27, 2006

(87) PCT Pub. No.: WO2005/119705

PCT Pub. Date: Dec. 15, 2005

(65) Prior Publication Data

US 2007/0221395 A1 Sep. 27, 2007

(30) Foreign Application Priority Data

Jun. 3, 2004 (JP) ..... 2004-165327

(51) Int. Cl.
*H01B 7/00* (2006.01)

(52) U.S. Cl. ..... 174/110 R; 174/120 R

(58) Field of Classification Search ..... 174/110 R, 174/120 R, 119 C, 120 SR, 121 R, 121 A
See application file for complete search history.

(56) References Cited

U.S. PATENT DOCUMENTS

| | | | | | |
|---|---|---|---|---|---|
| 4,600,806 | A | * | 7/1986 | Beretta | 174/121 A |
| 5,521,009 | A | * | 5/1996 | Ishikawa et al. | 428/375 |
| 5,597,981 | A | * | 1/1997 | Hinoshita et al. | 174/110 R |
| 6,248,446 | B1 | * | 6/2001 | Kikuchi et al. | 428/383 |
| 6,849,517 | B2 | * | 2/2005 | Chung et al. | 438/396 |
| 2002/0001715 | A1 | * | 1/2002 | Redondo et al. | 428/375 |
| 2006/0137897 | A1 | * | 6/2006 | Grogl et al. | 174/120 R |

FOREIGN PATENT DOCUMENTS

| | | | | |
|---|---|---|---|---|
| DE | 4332914 | A | * | 3/1995 |
| DE | EP1367094 | | * | 5/2003 |
| DE | EP 1388867 | A | * | 6/2003 |
| JP | A-01-302611 | | | 12/1989 |
| JP | 10-340639 | A | * | 12/1998 |
| JP | A-10-340635 | | | 12/1998 |
| JP | A-10-340639 | | | 12/1998 |
| JP | A-11-219626 | | | 8/1999 |
| JP | A-2000-207952 | | | 7/2000 |

* cited by examiner

*Primary Examiner*—William H Mayo, III
(74) *Attorney, Agent, or Firm*—Oliff & Berridge, PLC

(57) ABSTRACT

A halogen-free light-weighted coated electric wire has a conductor and a coating layer covering the outer circumference of the conductor. The coating layer includes an outer layer having a halogen-free resin composition and Shore D hardness of 50 or above and an inner layer having an olefin based flame retardant composition. A total thickness of the coating layer is 0.3 mm or less

2 Claims, No Drawings

COATED ELECTRIC WIRE

TECHNICAL FIELD

The present invention relates to halogen free coated electric wires which are used for parts of automobiles or the like and do not contain halogen elements.

BACKGROUND ART

Polyvinylchloride resins, having excellent flame retardance, have been generally used as a coating material for coated electric wires employed to parts of automobiles, electric and electronic devices, and the like.

However, the polyvinylchloride resins, contrary to their excellent flame retardance, have a problem that, since they contain halogen elements in their molecular chains, they release harmful halogenous gases to atmosphere while the automobiles are fired or the electric and electronic devices are burned for disposal, causing environmental pollution.

To solve this problem, flame-retardant resin compositions freed from halogens are developed which comprise polyethylene or polypropylene as a base resin and a metal hydrate such as magnesium hydroxide as a flame retardant. These flame-retardant halogen-free resin compositions, however, have a disadvantage of poor mechanical properties such as abrasion resistance, since they require addition of metal hydrates in a large amount as the flame retardant.

To solve such disadvantage mentioned above, a coated electric wire having two coating layers has been developed (Patent Document 1).

The coating layers of the coated electric wire are composed of an outer layer and inner layer with blending a flame retardant in the inner layer in larger amount than in the outer layer, thereby preventing the outer layer from deterioration of mechanical properties as well as retaining more flame retardancy in the inner layer.

However, if the coated electric wire relies only on an inner layer about its flame retardancy, a large amount of flame retardant needs to be added, and the inner layer drastically loses the flexibility thereof, deteriorating fundamental properties required to the electric wire. Therefore, two-layer coated electric wires conventionally provided cannot avoid to add a certain amount of a flame retardant in the outer layer thereof. Other additives, such as antiaging agents, are also added to the outer layer for various purposes. However, such additives are added in so large amount that resulting mechanical properties such as abrasion resistance and scratch damage resistance are not necessarily satisfactory.

Moreover, requirements of weight saving for various coated electric wires currently have become stronger. Particularly, according to requirements of lightening a body of automobiles, the requirements of saving weights of coated electric wires spread not only to reducing diameter of conductors but also to thinning coating layers. As the result, scratch damage resistance of the coated electric wires has become a big issue. In other words, when thick coating layers are allowed, the problems of scratch damage don't appear, but when the thickness of the coating layers becomes smaller, conductors could be exposed by even a slight scratch damage.

Furthermore, as wiring becomes more complex, flexibility of coated electric wires becomes more important, causing difficulty to add flame retardants to the inner layer in a large amount.

Patent Document: JP 1-302611A.

DISCLOSURE OF THE INVENTION

Problems to Be Solved by the Invention

The invention is to provide a halogen-free and lightweight coated electric wire which has excellent flame retardance as well as superior mechanical properties, particularly in scratch damage resistance, and moreover has a flexibility allowing more complex wiring.

Means to Solve the Problems

The inventors, after having intensively studied, have found the followings, and then completed the invention:

an electric wire coated with a coating layer having a certain thickness or less can endure scratch damages by providing a Shore D hardness of 50 or more to the outer layer thereof;

to achieve this endurance, an additive to be added to the outer layer must be suppressed in a small amount;

this suppression increases an amount of a flame retardant to be added to an inner layer and causes decrease of flexibility thereof;

this flexibility decrease however hardly affects to a whole flexibility of the electric wire having the coating layer having a certain thickness or less because the whole thickness of the layers is thin; and consequently such coated electric wire can secure a flexibility sufficiently allowing more complex wiring.

One of the preferable aspects of the present invention is a coated electric wire having a conductor and a coating layer covering the outer circumference of the conductor.

The coating layer has an outer layer having a halogen-free resin composition with a Shore D hardness of 50 or more and an inner layer having an olefin based flame retardant resin composition.

The coating layer has a total thickness of 0.3 mm or less.

Because the outer layer is a layer having a Shore D hardness of 50 or more, the conductor is not exposed under usual scratch damages even if the total thickness of the coating layer is small.

Because the inner layer is composed of a layer having an olefin based flame retardant resin composition, the flame retardance can be secured by this layer. On the other hand, the outer layer must suppress addition of various additives in small amounts to secure a Shore D hardness of 50 or more. Because of this suppression, an increased amount of flame retardant need be added in the inner layer. However this increased addition of the flame retardant has little affect to a flexibility of the electric wire because of a thin coating layer having a total coating layer thickness of 0.3 mm or less, thereby retaining a flexibility of the electric wire to allow more complex wiring. If the total thickness of the coating layer is less than 0.1 mm, it causes difficulty to endure scratching damages, thus the total thickness is preferably 0.1 mm or more.

Because an olefin resin composition not containing halogens in its molecular chain is used for the inner layer and a halogen-free resin composition not containing halogens is also used for the outer layer, the coated electric wire does not cause a problem of environmental pollution. Therefore, the coated electric wire is particularly preferably used as electric wires for automobiles.

An intermediate layer having a halogen-free resin composition may be disposed between the outer layer and inner layer.

An intermediate layer comprising a halogen-free resin composition may be disposed between the outer layer.

The halogen-free resin composition used for the outer layer is preferably an olefin resin composition due to its character of repelling water and inexpensive cost.

One of the preferable aspects of the present invention is the above coated wire, wherein the halogen-free resin composition is an olefin resin composition.

The outer layer is preferably added with additives, particularly oxide fillers, silicate fillers, antiaging agents, lubricants, plasticizers, or antistatic agents, to enhance various properties thereof, the additives. In this case, if the additives are added more than 30 parts by weight with respect to 100 parts by weight of a base polymer of the outer layer mentioned above, the outer layer becomes difficult to achieve the Shore D hardness of 50 or more. Therefore, the amount of the additives is preferably suppressed to 30 parts by weight or less.

One of the preferable aspects of the present invention is the above coated wire, wherein the halogen-free resin composition is an olefin resin composition.

One of the preferable aspects of the present invention is the above coated wire, wherein the outer layer contains oxide fillers, silicate fillers, antiaging agents, lubricants, plasticizers, or antistatic agents in an amount of 30 parts by weight or less with respect to 100 parts by weight of the base polymer of the outer layer mentioned above.

If a layer thickness of the outer layer is less than 1 μm, possibilities of exposing the conductor increase depending on situations of damages scratched. Therefore, the layer thickness of the outer layer is preferably 1 μm or more. On the other hand, if the layer thickness thereof is more than 100 μm, it tends to become difficult to secure a flame retardance of the whole wire with a flame retardant added to the inner layer. Therefore, the layer thickness of the outer layer is preferably 1 to 100 μm, more preferably 5 to 100 μm. The optimal layer thickness is 20 to 60 μm.

One of the preferable aspects of the present invention is the above coated wire, wherein the layer thickness of the outer layer is 1 to 100 μm.

The flame-retardant olefin resin composition for the inner layer can be obtained by providing flame retardancy to an olefin resin composition with a flame retardant or the like. For this purpose, preferably, a metal hydrate is used as the flame retardant. The metal hydrates can exert the flame retardance to the whole coated electric wire when it is provided to the inner layer in an amount of 50 parts by weight or more with respect to 100 parts by weight of the base polymer. On the other hand, it tends to reduce mechanical properties such as flexibility when being provided in an amount of more than 200 parts by weight, therefore preferably being 200 parts by weight or less.

One of the preferable aspect of the present invention is the above coated electric wire, wherein the inner layer contains a metal hydrate in an amount of 50 to 200 parts by weight with respect to 100 parts by weight of a base polymer of the inner layer.

As the layer thickness of the outer layer increases, the metal hydrate added as a flame retardant in the inner layer must be increased. According to results a study conducted by the inventors about relations between the layer thickness of the outer layer and the amount of a flame retardant within the range of amount defined above with using various kinds of metal hydrates, when letting X (μm) be the layer thickness of the outer layer and Y(phr) be the amount of a flame retardant to be added to the inner layer, particularly preferable flame retardance can be achieved by satisfying the relation represented by the formula $Y-40 \geqq 1.2X$.

One of the preferable aspects of the present invention is the above coated electric wire, wherein, when letting X (μm) be the layer thickness of the outer layer and Y(phr) be the amount of a flame retardant to be added to the inner layer, the formula $Y-40 \geqq 1.2X$ is satisfied.

The coating layers increase their heat resistance by being cross-linked. Since the coated electric wire has a small total thickness of the coating layers, it is significant to cross link the above-mentioned outer layer and/or inner layer depending on requirements.

One of the preferable aspects of the present invention is the above coated electric wire, wherein the outer layer and/or inner layer are cross linked.

Effects of the Invention

The coated electric wire of the invention can avoid a problem of environmental pollution caused by halogenous gases, enables weight saving of wires as well as never exposes conductors by scratching in spite of a small layer thickness of the coating layers thereof. Furthermore, it has flexibility sufficiently allowing more complex wiring with retaining the flame retardance.

BEST MODE FOR CARRYING OUT THE INVENTION

The coated electric wire of the invention has a conductor and a coating layer covering the outer circumference of the conductor, wherein the coating layer includes an outer layer containing a halogen-free resin composition with a Shore D hardness of 50 or more and an inner layer containing an olefin based flame retardant resin composition, and the coating layer has a total thickness of 0.3 mm or less.

The olefin resin used for the outer layer or inner layer of the coated electric wire of the invention may be a single olefin resin, a combination of two or more kinds of olefin resins, or a combination of an olefin resin as a major ingredient and one or two or more kinds of rubbers. When being used in combination, the olefin resin and rubber to be used in combination may be combined as a single form thereof or may be combined after making a mixture having an olefin resin of a major ingredient.

The olefin resins used for the invention preferably include polypropylene, low-density polyethylene, linear low-density polyethylene, high-density polyethylene, ethylene-α-olefin copolymer, ethylene-vinyl ester copolymers, ethylene-α,β-unsaturated carboxylic acid alkyl ester copolymers, and the like.

In this case, methods for producing the ethylene-α-olefin copolymer mentioned above include moderate- or low-pressure polymerization methods with using Ziegler catalysts or single-site catalysts, and other known methods. The ethylene-α-olefin copolymer includes copolymers of ethylene and an α olefin with carbon numbers of 3 to 20 such as propylene, 1-butene, 4-methyl-1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-nonadecene, 1-eicosene, 9-methyl-1-decene, 11-methyl-1-dodecene, and 12-ethyl-1tetradecene.

The vinyl ester monomer used for producing the above-mentioned ethylene-vinyl ester copolymers includes vinyl propionate, vinyl acetate, vinyl caproate, vinyl caprylate, vinyl laurylate, vinyl stearate, vinyl trifluoroacetate, and the like.

The α,β-unsaturated carboxylic acid alkyl ester monomer used for producing the ethylene-α,β-unsaturated carboxylic acid alkyl ester copolymers includes methyl acrylate, methyl metaacrylate, ethyl acrylate, ethyl metaacrylate, and the like.

As mentioned above, the olefin resin used for the outer layer or inner layer of the invention may be used in combination with a rubber. The rubbers preferably include ethylene-propylene-based rubbers, butadiene-based rubbers, isoprene-based rubbers, natural rubbers, nitrile rubbers, isobutylene rubbers, and the like.

In this case, the above mentioned ethylene-propylene-based rubbers include random copolymers mainly composed of ethylene and propylene, random copolymers mainly composed of ethylene, propylene and a diene monomer, as the third component, such as dicyclopentadiene or ethylidene norbornene, and the like.

The above mentioned butadiene-based rubbers are defined by copolymers comprising butadiene as an ingredient, which include styrene-butadiene block copolymers and hydrogenated or partially hydrogenated derivatives thereof such as styrene-ethylene-butadiene-styrene copolymers, 1,2-polybutadiene, maleic anhydride-modified styrene-ethylene-butadiene-styrene copolymers, modified butadiene rubbers having a core-shell structure, and the like.

The above mentioned isoprene-based rubbers are defined by copolymers comprising isoprene as an ingredient, which include styrene-isoprene block copolymers and hydrogenated or partially hydrogenated derivatives thereof such as styrene-ethylene-isoprene-styrene copolymers, maleic anhydride-modified styrene-ethylene-isoprene-styrene copolymers, modified isoprene rubbers having a core-shell structure, and the like.

The flame-retardant olefin resin composition used for the inner layer of the invention is preferably an olefin resin composition added with a metal hydrate as a flame retardant.

The metal hydrate preferably includes magnesium hydroxide, aluminum hydroxide, or calcium hydroxide. Among them, magnesium hydroxide is preferable because of its high decomposition temperature of about 360° C.

Their average particle diameter (D50) is preferably 0.5 to 5.0 μm. When the average particle diameter (D50) is less than 0.5 μm, the particles often cause secondary agglomeration with each other, resulting in lowering of a mechanical strength. When the average particle diameter (D50) is more than 5.0 μm, a mechanical strength is also lowered and an appearance is often deteriorated.

When being used for various materials, the surface of metal hydrates is conventionally treated with various agents. In this invention, the surface thereof may be treated with a suitable agent and by a suitable method depending on requirements to improve mechanical properties and the like. The agents used for the surface treatment preferably include fatty acids, fatty acid metal salts, silane coupling agents, titanate coupling agents, and the like.

When the coating layer of the coated electric wire of the invention is cross linked to improve heat resistance and the like, the cross-linking may be carried out by irradiating an ionizing radiation or using a cross-linking agent such as organic peroxides. When a coated electric wire with thin coating layer is cross linked, a cross-linking auxiliary is preferably used for effectiveness.

Materials for the conductor of coated electric wire of the invention are not particularly limited, preferably being copper, aluminum, and the like. The conductor may be a single wire or a twisted wire. A twisted wire is preferable in view of flexibility. The conductor preferably has a cross sectional area of 0.05 to 2.0 $mm^2$.

EXAMPLES

Examples and Comparative Examples are described as follows. The invention should not be construed to be limited thereto. Various modifications can be conducted to the following Examples within the scope identical or equivalent to the invention.

In Examples and Comparative Examples, electric wires were produced by preparing a conductor with a cross sectional area of 0.5 $mm^2$ composed of twisting seven soft-annealed copper wires, and then covering the outer circumference of the conductor by extrusion with an inner layer and outer layer, each of which consists of an insulating layer represented in the following Tables respectively and of which total thickness was 0.20 mm. The electric wires thus produced were subjected to various evaluations with the following evaluation methods.

(Evaluation of Abrasion Resistance)

According to the standard of JASO D611-94 defined by Society of Automotive Engineers of Japan, Inc., blade reciprocating method was applied as follows:

cutting out the test piece with 750 mm long from the coated electric wire produced by the above mentioned procedure, placing the test piece on a table at a room temperature of 25° C., reciprocating a blade on the surface of coating material of the test piece along the axial direction thereof in a range of 10 mm long with a load of 7 N at a rate of 50 times per minute, and counting the reciprocation number until the coating layer was abraded and the blade become in contact with the conductor.

Thereafter, the test piece was shifted in 100 mm and rotated at 90 degree in a clockwise direction to be subject to the next measurement with the same manner. This measurement was conducted totally three times for the same test piece. When the minimum reciprocation number is 200 or more, the test piece was considered as acceptable quality level.

(Evaluation of Insulating Strength)

Evaluation was carried out as follows:

cutting out the test piece with 900 mm long from the coated electric wire produced by the above mentioned procedure, peeling off the insulating bodies with 25 mm long respectively at opposite ends of the test piece, stretching the test piece straightly without providing a tension, and then putting it on an iron bar with ϕ 3.2 mm to cross them at right angle.

Thereafter, the test piece was loaded with an iron anvil of which weight was increased at a rate of 22.2 N (2.27 kgf) per minute with a lever-advantage 10. The load was measured, when the iron bar become in contact with the conductor.

After having measured at one point, the test piece was shifted in 50 mm and rotated at 90 degree in a clockwise direction to be subjected to the next measurement. In this manner, totally 4 points were measured for the same test piece. This measurement was repeated three times (n=3) and then calculating average load. The test piece having average load of 20 N or more was considered as acceptable quality level.

(Evaluation of Flame Retardance)

The evaluation was conducted according to the standard of JASO D611-94 defined by Society of Automotive Engineers of Japan, Inc. A test piece was cut out with 300 mm long from the coated electric wire produced by the above mentioned procedure. Thereafter, the test piece was put in a box made of iron and placed horizontally;

preparing a Bunsen burner with a diameter of 10 mm to form a reducing flame, putting a tip of the reducing flame at a lower and center side of the test piece until the test piece threw out its own flame in 30 seconds, and then carefully taking away the flame of the burner to measure a time remaining the flame of the test piece. The test piece having a flame-remaining time of 15 seconds or less was considered as acceptable quality level, and that of more than 15 seconds was considered as not acceptable.

(Evaluation of Flexibility)

Flexibility was judged from the hand feeling obtained when bending a wire by hands; the wire giving favorable feeling was considered as acceptable quality level, and that giving unfavorable feeling was considered as not acceptable.

The results obtained are shown in Tables 1 to 4. In Tables, evaluation results of insulating strength, flame retardance, and flexibility are exhibited with a mark of ○ for the acceptable quality levels and a mark of X for the unacceptable quality levels.

The materials shown in the following Tables were the materials represented as follows:

PP1 (Polypropylene): Idemitu Petrochemical Co., Ltd., E-150GK,

PP2 (Polypropylene): SHIRAISHI CALCIUM Co., Ltd., Polybond 3002,

HDPE (High-density polyethylene): Japan Polypropylene Corporation, Novatech HY540, LLDPE (Linear low-density polyethylene): Japan Polypropylene Corporation, Novatech UE320, EVA (Ethylene-vinylacetate): DU PONT-MITSUI POLYCHEMICALS Co., Ltd., Evaflex EV270, SEBS (Styrene-ethylene-butylene-styrene): KRATON POLYMERS JAPAN Co., Ltd., KRATON FG1901X, Magnesium hydroxide 1: Martinswerk GmbH MAGNIFIN H10, Magnesium hydroxide 2: Kyowa Chemical Industry Co., Ltd., Kisma 5J, Basic magnesium sulfate: Ube Material Industries Ltd., Mos Hige, Antiaging agent: Ciba Specialty Chemicals K.K., IRGANOX1010, Metal deactivator: Ciba Specialty Chemicals K.K., IRGANOX1024, Sulfur-based additive: OUCHI SHINKO CHEMICAL INDUSTRIAL CO., LTD., Nocrack MB, Metal oxide: HakusuiTech Co., Ltd., zinc oxide

TABLE 1

| | Example 1 | | Example 2 | | Example 3 | | Comparative Example 11 | | Comparative Example 12 | |
|---|---|---|---|---|---|---|---|---|---|---|
| | Outer layer | Inner layer | Outer layer | Inner layer | Outer layer | Inner layer | Outer layer | Inner layer | Outer layer | Inner layer |
| Producing Conditions | | | | | | | | | | |
| P P 1 | 100 | 50 | 100 | 90 | 100 | 90 | | | 80 | 60 |
| P P 2 | | | | 10 | | | | | 20 | 10 |
| H D P E | | | | | | | 90 | 70 | | |
| L L D P E | | 50 | | | | | | | | |
| E V A | | | | | | | | 30 | | 30 |
| S E B S | | | | | | 10 | 10 | | | |
| Magnesium hydroxide 1 | | 60 | | | | 120 | | | | |
| Magnesium hydroxide 2 | | | | 140 | | | | 200 | | 160 |
| Basic magnesium sulfate | | | | | | | | | | |
| Antiaging agent | 1 | | 3 | 3 | | 3 | 1 | 1 | 1 | 1 |
| Metal deactivator | 1 | | 1 | 1 | | 0.5 | | 0.5 | 3 | 1 |
| Sulfur-based additive | | | 5 | 5 | | 5 | | | 3 | |
| Metal oxide | | | 5 | 5 | | 5 | | | 3 | |
| Evaluation Results | | | | | | | | | | |
| Thickness of Outer Layer (μm) | 5 | | 50 | | 40 | | 100 | | 70 | |
| Hardness of Outer Material | D 60 | | D 61 | | D 60 | | D 52 | | D 62 | |
| Abrasion resistance | 500 | | 2500 | | 2100 | | 1000 | | 3500 | |
| Insulating strength | ○ | | ○ | | ○ | | ○ | | ○ | |
| Flame retardance | ○ | | ○ | | ○ | | ○ | | ○ | |
| Flexibility | ○ | | ○ | | ○ | | ○ | | ○ | |

TABLE 2

| | Comparative Example 13 | | Example 7 | | Example 8 | | Example 9 | | Example 10 | |
|---|---|---|---|---|---|---|---|---|---|---|
| | Outer layer | Inner layer | Outer layer | Inner layer | Outer layer | Inner layer | Outer layer | Inner layer | Outer layer | Inner layer |
| Producing Conditions | | | | | | | | | | |
| P P 1 | | | 90 | 90 | | | | | 100 | 80 |
| P P 2 | | | 10 | 10 | | | | | | |
| H D P E | 100 | 50 | | | 100 | 50 | 100 | | | |
| L L D P E | | 50 | | | | | | 60 | | |
| E V A | | | | | | 30 | | | | |
| S E B S | | | | | | 20 | | 40 | | 20 |
| Magnesium hydroxide 1 | | 50 | | | | 100 | | 90 | | |
| Magnesium hydroxide 2 | | | | 140 | | | | | | 120 |
| Basic magnesium sulfate | 30 | | 10 | | | | | | | 20 |
| Antiaging agent | | 1 | 1 | 2 | | 3 | | 1 | | 1 |
| Metal deactivator | | 1 | 2 | 0.2 | | 0.5 | | 0.5 | | 1 |
| Sulfur-based additive | | | 3 | | | 5 | | | | 5 |
| Metal oxide | | | 5 | | | 5 | | | | 5 |
| Evaluation Results | | | | | | | | | | |
| Thickness of Outer Layer (μm) | 20 | | 5 | | 40 | | 35 | | 50 | |
| Hardness of Outer Material | D 57 | | D 66 | | D 56 | | D 56 | | D 60 | |
| Abrasion resistance | 600 | | 1150 | | 1400 | | 1000 | | 2200 | |
| Insulating strength | ○ | | ○ | | ○ | | ○ | | ○ | |
| Flame retardance | ○ | | ○ | | ○ | | ○ | | ○ | |
| Flexibility | ○ | | ○ | | ○ | | ○ | | ○ | |

TABLE 3

| | Comparative example 1 | | Comparative example 2 | | Comparative example 3 | | Comparative example 4 | | Comparative example 5 | |
|---|---|---|---|---|---|---|---|---|---|---|
| | Outer layer | Inner layer | Outer layer | Inner layer | Outer layer | Inner layer | Outer layer | Inner layer | Outer layer | Inner layer |
| Producing Conditions | | | | | | | | | | |
| P P 1 | | | 100 | 90 | | | | | 90 | 90 |
| P P 2 | | | | | | | | | 10 | 10 |
| H D P E | | 90 | | | 100 | 50 | 100 | 50 | | |
| L L D P E | 100 | | | | | 50 | | 50 | | |
| E V A | | 10 | | | | | | | | |
| S E B S | | | | 10 | | | | | | |
| Magnesium hydroxide 1 | | 140 | | | | 40 | | | | 100 |
| Magnesium hydroxide 2 | | | 40 | 140 | | | | 230 | | |
| Basic magnesium sulfate | | | | | | | | | 10 | |
| Antiaging agent | | 2 | 1 | 3 | | 1 | | 1 | 0.5 | 1 |
| Metal deactivator | | 0.5 | | 1 | | 3 | | 3 | | 1 |
| Sulfur-based additive | | | | | | 3 | | 3 | | |
| Metal oxide | | | | | | 3 | | 3 | | |
| Evaluation Results | | | | | | | | | | |
| Thickness of Outer Layer μm) | 60 | | 40 | | 30 | | 30 | | 4 | |

TABLE 3-continued

| | Comparative example 1 | | Comparative example 2 | | Comparative example 3 | | Comparative example 4 | | Comparative example 5 | |
|---|---|---|---|---|---|---|---|---|---|---|
| | Outer layer | Inner layer | Outer layer | Inner layer | Outer layer | Inner layer | Outer layer | Inner layer | Outer layer | Inner layer |
| Hardness of Outer Material | D 40≧ | | D 62 | | D 56 | | D 56 | | D 65 | |
| Abrasion resistance | 150 | | 2400 | | 700 | | 500 | | 1100 | |
| Insulating strength | X | | X | | ○ | | ○ | | X | |
| Flame retardance | ○ | | ○ | | X | | ○ | | ○ | |
| Flexibility | ○ | | X | | ○ | | X | | ○ | |

TABLE 4

| | Comparative example 6 | | Comparative example 7 | | Comparative example 8 | | Comparative example 9 | | Comparative example 10 |
|---|---|---|---|---|---|---|---|---|---|
| | Outer layer | Inner layer | Outer layer | Inner layer | Outer layer | Inner layer | Outer layer | Inner layer | One layer |
| Producing Conditions | | | | | | | | | |
| P P 1 | 90 | 90 | 100 | 60 | | | | | |
| P P 2 | 10 | 10 | | 10 | | | | | |
| H D P E | | | | | 100 | 80 | 100 | 80 | 50 |
| L L D P E | | | | | | | | | 50 |
| E V A | | | | 30 | | 20 | | 20 | |
| S E B S | | | | | | | | | |
| Magnesium hydroxide 1 | | 100 | | 40 | | | | 120 | 50 |
| Magnesium hydroxide 2 | | | | | | 50 | | | |
| Basic magnesium sulfate | 10 | | | | 10 | | | | |
| Antiaging agent | 0.5 | 1 | | 1 | | 1 | | 1 | 1 |
| Metal deactivator | | 1 | | 1 | | 1 | | 1 | 1 |
| Sulfur-based additive | | 5 | | | | | | | |
| Metal oxide | | 5 | | | | | | | |
| Evaluation Results | | | | | | | | | |
| Thickness of Outer Layer (μm) | 110 | | 10 | | 30 | | 80 | | — |
| Hardness of Outer Material | D 65 | | D 60 | | D 57 | | D 56 | | — |
| Abrasion resistance | 4000 | | 850 | | 900 | | 850 | | 100 |
| Insulating strength | ○ | | ○ | | ○ | | ○ | | X |
| Flame retardance | X | | X | | X | | X | | ○ |
| Flexibility | X | | ○ | | ○ | | ○ | | ○ |

As apparent from Examples 1-10, the coated electric wires of the invention exhibit sufficient Abrasion resistance, Insulating strength, Flame retardance and Flexibility. On the other hand, the coated electric wires of Comparative examples 1 and 10 are not good in Abrasion resistance and Insulating strength. The coated electric wires of the other Comparative examples are not satisfactory in at least one property of Insulating strength, Flame retardance and Flexibility, either.

What is claimed is:

1. A coated electric wire comprising a conductor and a coating layer covering the outer circumference of the conductor, wherein the coating layer has an outer layer comprising a halogen-free resin composition with a Shore D hardness of 50 or more and an inner layer comprising an olefin based flame retardant resin composition, the coating layer has a total thickness of 0.3 mm or less, the outer layer mentioned above contains oxide fillers, silicate fillers, antiaging agents, lubricants, plasticizers, or antistatic agents in an amount of 30 parts by weight or less with respect to 100 parts by weight of the base polymer of the outer layer mentioned above, the layer thickness of the outer layer mentioned above is 5 to 50 μm, the inner layer mentioned above contains a metal hydrate in an amount of 60 to 140 parts by weight with respect to 100 parts by weight of a base polymer of the inner layer mentioned above, and, when letting X (μm) be the layer thickness of the outer layer mentioned above and Y(phr) be the amount of a flame retardant to be added to the inner layer mentioned above, the formula $Y-40 \geqq 1.2X$ is satisfied.

2. The coated electric wire according to claim 1, wherein the halogen-free resin composition mentioned above is an olefinic resin composition.

* * * * *